US005300919A

United States Patent [19]

Caddock

[11] Patent Number: 5,300,919

[45] Date of Patent: Apr. 5, 1994

[54] VIBRATION AND SHOCK-RESISTANT FILM-TYPE POWER RESISTOR

[75] Inventor: Richard E. Caddock, Roseburg, Oreg.

[73] Assignee: Caddock Electronics, Inc., Riverside, Calif.

[21] Appl. No.: 879,185

[22] Filed: May 5, 1992

[51] Int. Cl.[5] ..... H01C 1/028

[52] U.S. Cl. ..... 338/250; 338/98; 338/230; 338/252; 338/7; 338/243; 338/308

[58] Field of Search ..... 338/250, 98, 256, 195, 338/51, 230, 252, 253, 243, 248, 7, 275, 309, 308; 357/70

[56] References Cited

U.S. PATENT DOCUMENTS

| | | | |
|---|---|---|---|
| 3,201,855 | 8/1965 | Hay | 29/155.63 |
| 3,206,704 | 9/1965 | Hay | 338/250 |
| 3,581,266 | 5/1971 | Weyenberg | 338/253 |
| 4,318,072 | 3/1982 | Zandman | 338/7 |
| 4,677,413 | 6/1987 | Zandman | 338/7 |
| 4,771,240 | 9/1988 | Meyer et al. | 338/32 R |
| 4,788,524 | 11/1988 | Ozaki | 338/275 |

OTHER PUBLICATIONS

Dale Electronics, Inc., one-sheet catalog sheet "MIL-R-39009, Type Rer, R Level Dale Type ERH and ENH Aluminum Housed".

*Primary Examiner*—Marvin M. Lateef
*Attorney, Agent, or Firm*—Richard L. Gausewitz

[57] ABSTRACT

The power resistor has a metal housing and heatsink, the bottom wall of which is planar and has a bolt hole therethrough for tight securing of the resistor to a chassis. A planar film-type power resistor is mounted in the housing and encapsulated therein, being held close to the bottom wall of the housing. Heat from the film-type resistor passes through the bottom wall into the chassis, the result being that the power rating of the resistor is high. The metal housing is die-cast of a zinc alloy, at extremely low cost yet with substantially the same heat-transmission characteristic as that of conventional die-castable aluminum alloys.

9 Claims, 3 Drawing Sheets

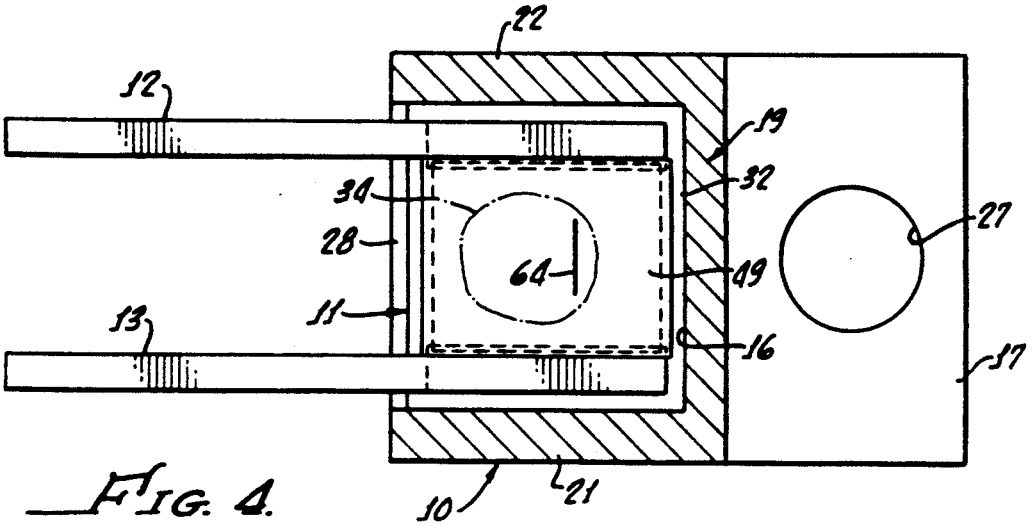
FIG. 4.
FIG. 6.
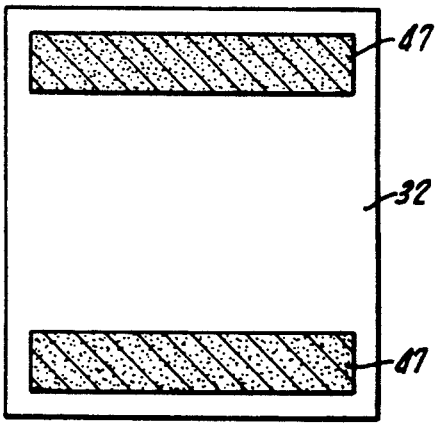
FIG. 5.
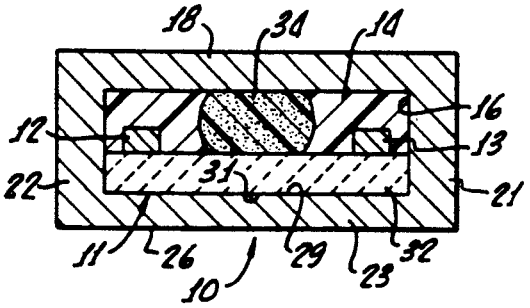
FIG. 7.
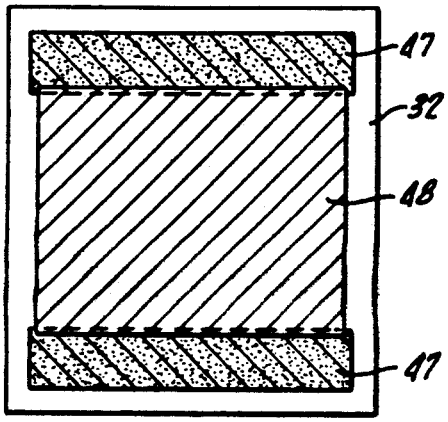
FIG. 8.
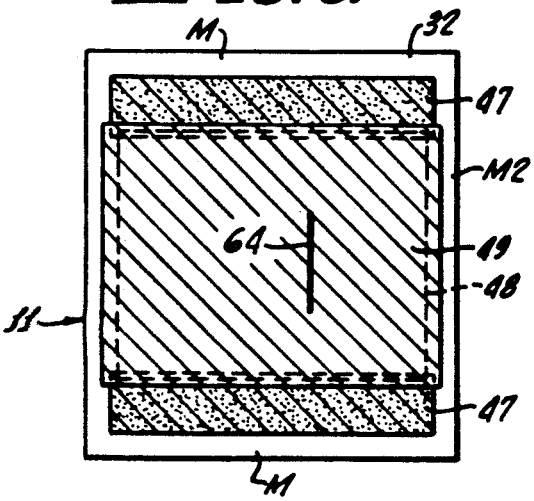

FIG. 9.
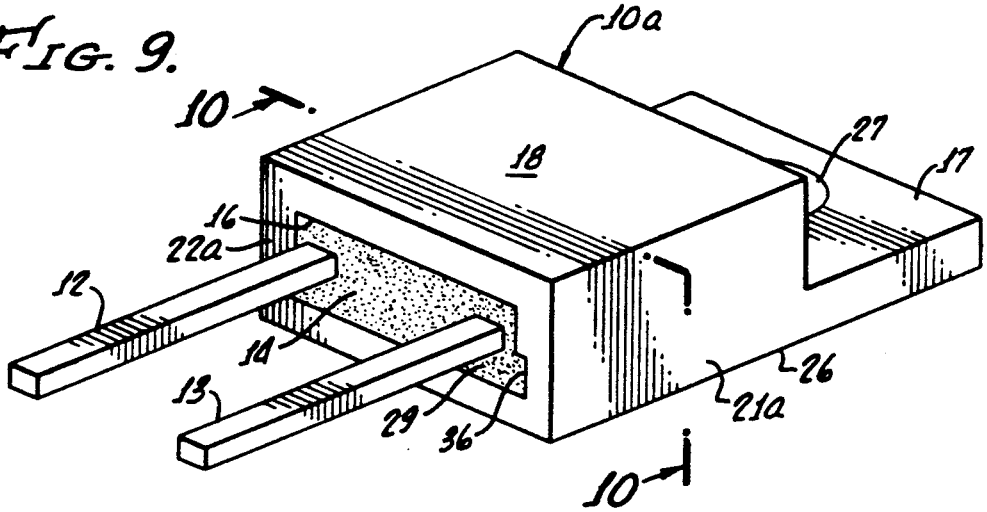
FIG. 10.
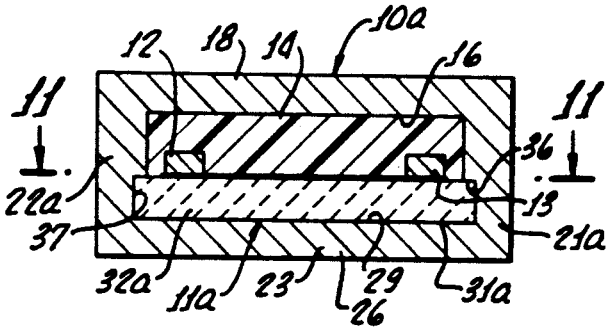
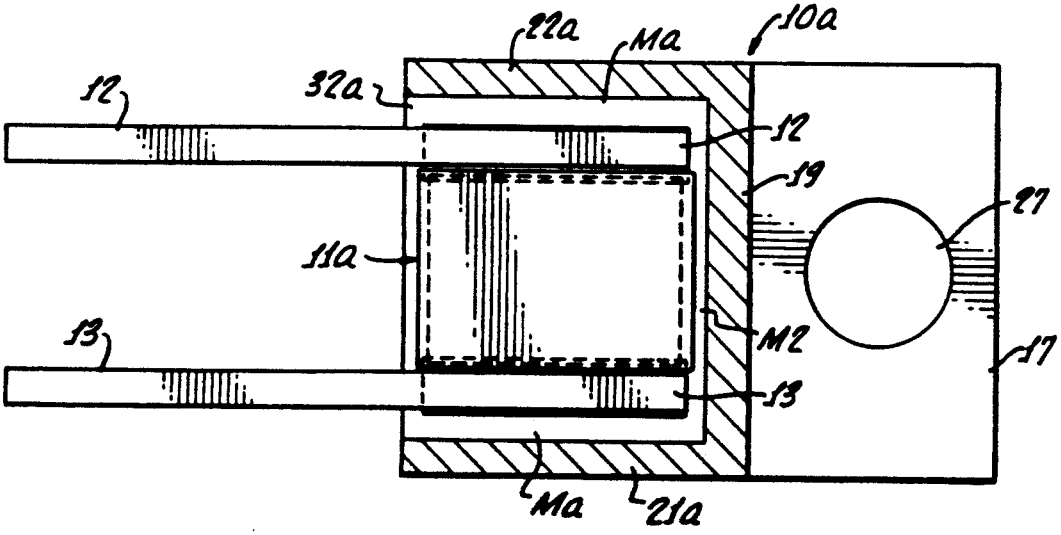
FIG. 11.

VIBRATION AND SHOCK-RESISTANT FILM-TYPE POWER RESISTOR

BACKGROUND OF THE INVENTION

Resistors have previously been made with metal housings, but have suffered from major drawbacks in critical areas. Most notably, these drawbacks are in the areas of cost, size, and power rating. Although for some limited applications cost is not a major factor, there are a great many applications where cost is of crucial importance.

Similarly, there are a great many applications where a high power rating—for a given size—is essential to commercial viability. Stated otherwise, it is extremely important that a resistor be capable of dissipating a large amount of power for its size, so that the resistor will fit into a particular space and will not become excessively hot.

For many applications it is required that the resistor be capable of withstanding large shocks and much vibration. Aerospace applications are examples of environments where shock and vibration resistance are paramount considerations. Relative to much more high-volume applications where these considerations are of major significance, reference is made to such common environments as the motor regions of vacuum cleaners and automobiles.

SUMMARY OF THE INVENTION

In accordance with one aspect of the present invention, a film-type resistor element is provided with a metal housing one wall of which is exteriorly and interiorly substantially flat. The housing is bolted to a chassis in such relationship that the exterior surface of such flat wall is in heat-transfer relationship to the chassis. The housing contains a flat film-type resistor element in efficient heat-transfer relationship to the interior surface of the indicated housing wall. The constructions and relationships are such that there is very efficient heat transfer from the resistive film to the chassis, thus causing the resistor to have a high power rating.

In the preferred embodiment, the metal housing is open at only one end, and is a die casting. The housing is filled with potting compound which fills the housing and, in combination with the housing walls, effectively locates, protects and insulates the film-type resistor element.

The housing is die cast of a zinc alloy, because this has been found to minimize cost while at the same time achieving substantially the same heat transfer as would be present through the wall of a die-castable aluminum housing. Such a die-castable aluminum housing is much more expensive than the zinc-alloy housing.

In accordance with one means for locating the film-type resistor in the housing, a solid wad of a resilient material is employed to resiliently press the film-type resistor against the heat-transfer wall of the housing. In accordance with another embodiment, grooves are provided in the housing to contain edge regions of the film-type resistor element for location thereof.

BRIEF DESCRIPTION OF THE DRAWINGS

FIG. 4 is a horizontal sectional view on line 4—4 of FIG. 1;

FIG. 5 is a vertical sectional view on line 5—5 of FIG. 1.

FIGS. 6, 7 and 8 are plan views showing steps in the manufacture of the resistor element;

FIG. 9 corresponds to Fig. but shows a second embodiment;

FIG. 10 is a vertical sectional view on line 10—10 of FIG. 9; and

FIG. 11 is a horizontal sectional view on line 11—11 of FIG. 10.

DETAILED DESCRIPTION OF THE PREFERRED EMBODIMENTS

Referring to FIGS. and 3, the power resistor comprises a metal housing and heatsink 10, a film-type resistor element leads 12 and 13 connected to the resistive film in element and potting compound (material) 14 to fill the housing portion of element 10 and encapsulate the resistor element 11.

Figure 1:
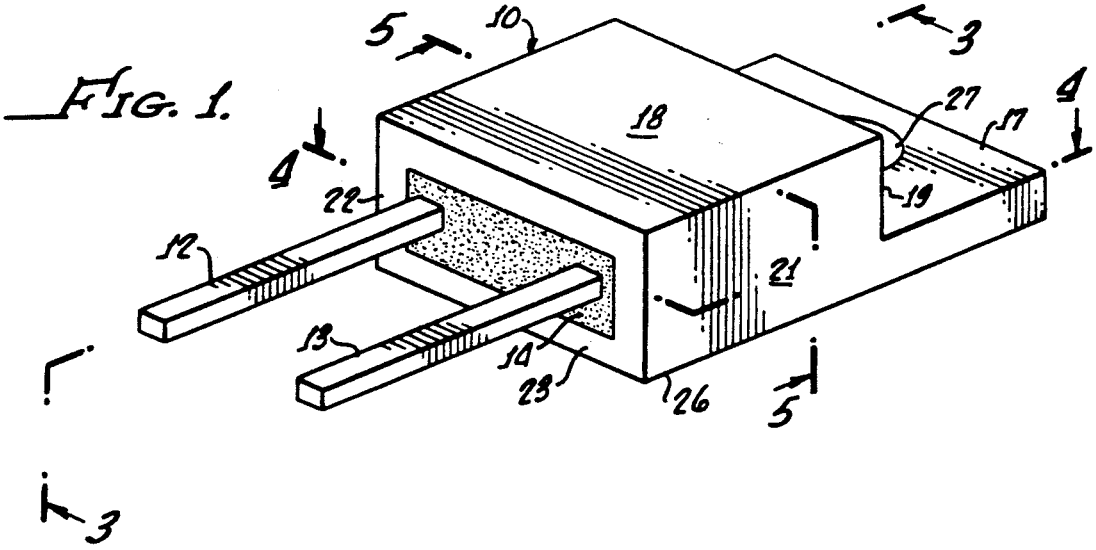
FIG. 1 is an isometric view of a resistor constructed in accordance with a first embodiment of the invention.
Figure 2:
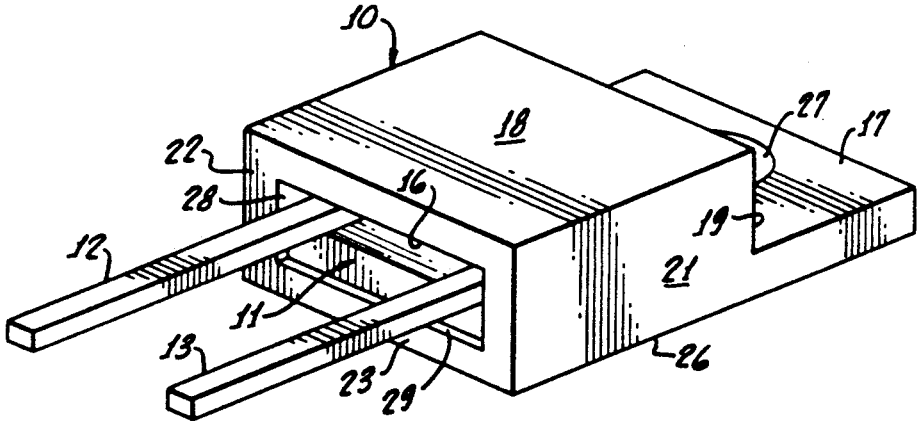
FIG. 2 is another isometric view of the resistor of the first embodiment but with the potting material unshown.

Housing and heatsink 10 comprises wall means to define a rectangular chamber 16 (FIG. 2) and also to form a heatsink and hold-down portion 17. The latter aids in conducting heat from the resistor element to an underlying flat metal chassis (not shown), and holds the wall means closely against such chassis.

The wall means defining chamber 16 comprise a top wall 18, an end wall 19, sidewalls 21,22, and a bottom wall 23. Top wall 18 and bottom wall 23 are parallel to each other. Sidewalls 21,22 are parallel to each other and are perpendicular to end wall 19 and to the top and bottom walls.

Bottom wall 23 is substantially coplanar with heatsink and hold-down portion 17, the latter being an extension that is integral with end wall 19 and with bottom wall 23. The bottom wall 23 is made thin for increased transmission of heat therethrough. For example, such wall may be 0.035 inch thick. Extension 17, on the other hand, is less thin so as to have sufficient strength to hold the housing portion of element 10 in close contact with the chassis. As an example, extension 17 may be 0.052 inch thick.

The bottom surface of wall 23 and of extension 17 is a continuous surface 26 where heat is transferred to the chassis. Such heat-transfer surface 26 lies in a single plane. To hold the power resistor against a flat surface of the chassis, a bolt (not shown) is extended through a central hole 27 in extension 17, such hole being adapted to be registered with a hole in the chassis. A nut and belleville spring (not shown) are also provided and are associated with the bolt.

The housing and heatsink 10 is a die-casting. It is made of zinc alloy. The preferred zinc alloy is Zamak 3 (AG40A). This is 0.25% (max.) copper, 3.6 to 4.5% aluminum, 0.02 to 0.05% magnesium, 0.100% iron, 0.005% (max.) lead, 0.004% (max.) cadmium, 0.003% tin, balance zinc (99.99% + purity).

It has been found that when the zinc alloy is employed, the die-casting can be made extremely cheaply yet still have a surprisingly high heat-transmission characteristic. Such characteristic is similar to that of those aluminum alloys that are capable of being die-cast. Such die-castable aluminum alloys cost much more than does the zinc alloy.

Referring next to the film-type resistor element 11, this comprises a thin flat rectangular (or square) substrate 32 onto which is applied a resistive film, as described subsequently. The leads 12,13 are electrically and mechanically connected to spaced portions of the film, and extend out the open end 28 (FIG. 2) of the housing, such open end being that end remote from end wall 19.

The potting compound (material) 14 is (except as stated below) caused to fill the chamber 16 in all portions thereof not occupied by resistor element There is, however, very little potting material between the flat upper surface 29 of bottom wall 23 (which upper surface is parallel to surface 26) and the bottom surface 31 of the substrate 32. Substrate 32 is shaped and sized to substantially fill chamber 16 at regions closely adjacent surface 29.

The resistive film portion of element 11 is on the upper side of the substrate 32. Thus, heat generated when current flows between leads 12,13 through the resistive material passes downwardly through substrate 32, thence through any potting material 14 that is between surfaces 29 and 31 (FIG. 3), and thence through the thin bottom wall 23 into the chassis. Some of the heat also passes downwardly through the lower portions of end wall 19 and sidewalls 21,22 and through the extension 17 and associated region of heat-transfer surface 26.

The result is a very efficient heat-transfer characteristic with consequent high power rating. The power rating of the present resistor is vastly greater than that of prior-art metal-housed resistors, of comparable size, known to applicant.

There will next be described the preferred methods and means for maintaining substrate 32 closely adjacent bottom wall 23 during and after the potting operation, for maximized heat-transfer characteristic.

Figure 3:
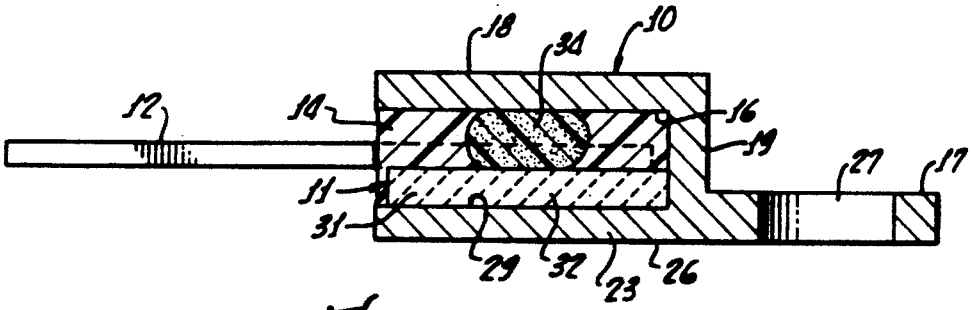
FIG. 3 is a vertical sectional view on line 3—3 of FIG. 1.

Referring to FIG. 3, the previously-formed resistor element 11 including its substrate portion 32 is disposed in chamber 16 in such relationship that the bottom surface 31 of the substrate is adjacent upper surface 29 of housing wall 23. Then, a pre-formed wad 34 of a resilient material is introduced into the space between top wall 18 and resistive element 11. Such wad 34 is selected to have a size sufficient that there is a pressing action of surface 31 against surface 29. In other words, the wad 34 has a size sufficiently large that it must be compressed (deformed) in order to be inserted between wall 18 and resistor element 11

Thereafter, liquid potting material 14 is poured into the chamber 16 while the open end 28 of housing 10 is in a horizontal plane and above end wall 19. The space between element 11 and walls 18,19,21 and 22—and surrounding wad 34—is thus filled with the liquid potting material 14. A heating step is then performed to set the potting material and to cause, by capillary action, potting material 14 to fill any space between surfaces 29 and 31 (FIG. 3). The potting compound between such surfaces is, however, very thin and cooperates with the substrate 32, bottom wall 23 and extension 17 in transferring heat from the resistive element to the chassis. There is a steep thermal gradient between the resistive film and the chassis, and this in combination with the described elements causes the great majority of heat to flow directly downwardly to the chassis.

Referring next to FIGS. 9 and 10, there is shown a metal housing and heatsink **10*a* that is identical to the one described above except that it is provided with internal grooves 36,37 in the portions of sidewalls 21*a*,22*a* that are immediately adjacent upper surface 29 of bottom wall 23. The grooves 36,37 are just sufficiently large to receive edge portions of substrate 32*a* of the film-type resistor element 11*a***.

With the present embodiment, resistor element **11*a* is inserted into chamber 16 in such relationship that edge portions of substrate 32*a* slide into grooves 36,37. Accordingly, the bottom surface 31*a* of substrate 32*a* is caused to be close to the upper surface 29 of bottom wall 23. Chamber 16 is then filled with liquid potting material 14 when the open end 28 of the housing is uppermost as described above, following which a heating operation is performed to set the potting material and to cause, by capillary action, filling of the space between bottom surface 31*a* and upper surface 29**.

CONSTRUCTION OF THE RESISTOR ELEMENTS 11 AND 11*a*

The upper surface of substrate 32 shown in FIG. 3 (or **32*a*, FIG. 11) has combination termination traces and pads 47 thereon, also has resistive film 48 thereon, and also has a protective coating 49 thereon. These are shown in FIGS. 6–8. Furthermore, the leads 12,13 are secured mechanically and electrically to traces and pads 47, longitudinally thereof. The substrate 32 acts not only as a substrate but as an electrical insulator or dielectric element, and further acts as a spacer to ensure that no portions of the leads 12,13** come too close to the housing.

Although substrate 32 is a good electrical insulator, it is selected to have relatively high thermal conductivity for a nonmetal element. The preferred substance for substrate 32 is aluminum oxide ceramic. Less preferred materials are beryllium oxide and aluminum nitride.

The leads 12,13 are elongate metal strips having rectangular cross-sections. Leads 12,13 are preferably, for best current flow and minimized resistance, sufficiently long that they extend nearly to the innermost edge of the substrate 32, while still projecting a desired distance out open end 28 of the housing.

Referring to FIG. 6, the combination traces and pads 47 are elongate rectangles, are applied by screen-printing, and lie parallel to opposite edge portions of the substrate 32, in parallel relationship to each other. The combination traces and pads 47 are adapted to—and later do—extend longitudinally of the housing. The material forming the combination traces and pads 47 is beryllium oxide and aluminum nitride. Following screen-printing, the ceramic element 32 is fired.

Referring to FIG. 7, a thick film 48 of resistive material is screen-printed onto ceramic substrate 32. The edge regions (top and bottom in FIG. 7) of resistive film 48 overlap somewhat the combination traces and pads 47, as illustrated. After being screen-printed onto the substrate, the ceramic element is again fired. The preferred resistive material comprises electrically-conductive complex metal oxides in a glass matrix, and is fired at a temperature in excess of 800 degrees C.

There is then screen-printed onto the entire upper surface of resistive film 48, and for slight distances past such film, a protective coating 49 preferably formed of glass. A relatively low melting point glass frit is screen-printed onto the substrate (and adjacent trace edges) as stated, and is fired at a temperature of about 500 degrees C. The major difference between the firing temperature of the resistive film 48, and that of the glass 49, is such that firing of the glass does not adversely affect the resistive film 48. The protective coating 49 prevents the potting material 14 from adversely affecting resistive film 48.

There is then screen-printed onto those portions of combination traces and pads 47 not covered by glass 19 a solder composition. Alternatively, the solder is applied by dipping. This composition preferably comprises 96.5% tin and 3.5% silver.

As the next step, the leads 12,13 are clamped to substrate 32, being firmly seated on the above-indicated solder (not shown) that was applied to combination traces and pads 47. Then, baking is effected in order to melt the solder and thereby secure the leads to the coated ceramic element. The leads are thus mechanically and electrically connected to such element.

Before potting takes place, the resistor is trimmed by laser scribing a slot or line 64 (FIG. 8) of appropriate length and width to achieve the desired resistance value.

Stated more definitely, slot 64 is cut through the resistive film 48, and is made progressively wider until the resistance value of the resistor is as desired.

It is emphasized that slot 64 is parallel to the direction of current flow. The termination traces 47 are parallel to each other, and slot 64 is made perpendicular to such traces. Current flows through the resistive film 48 directly between the termination traces, and perpendicular to them. The direction of current flow through the resistive film is parallel to slot 64.

By making slot 64 parallel to such current flow, important benefits are achieved vis-a-vis obtaining uniformly high current density, and high power-handling capability.

As above indicated, the substrate 32 acts as a spacer and dielectric to space the resistive film 48 and the termination strips 47 away from bottom wall 23 of the metal housing and heatsink element 10. For maximized reliability, and ease of production, the present resistor element 11 (FIG. 4) is so constructed that the conductive films on the upper surface thereof are spaced away from end wall 19 and sidewalls 21,22 of the housing. This is done by outwardly extending marginal portions of the substrate 32—which marginal portions have not been coated with conductive material. In addition, the forward edge of the substrate 32 is spaced inwardly from the plane of the open end 28 of the housing, as shown in FIG. 4. In addition, the outer (nearest open end 28) edges of the resistive film and the traces are spaced from the substrate edge parallel thereto.

The widths of such marginal portions of the substrate, and the amount of such spacing from the plane of the open end 28, are such that there is spacing from the walls 19 and 21,22 comparable to the thickness of substrate 32, in the preferred embodiment.

Thus, for example, where the substrate 32 has a thickness of about 0.030 inch, as is preferred, the widths of the marginal portions of the substrate are preferably also about 0.030 inch. The marginal portions are indicated by the letters M, M1 and M2 in FIG. 8. Such figure shows the resistor element 11 for the embodiments of FIGS. 1–5, in which there are no grooves in the housing.

Referring to FIG. 11, marginal regions Ma are shown that are larger (wider) than those shown in FIGS. 6 through 8. The amount of increased dimension is comparable to the depths of the grooves 36,37 (FIG. 10). Thus, the substrate edges provide the added spacing keeping the films and traces away from the housing.

SUMMARY

There are thus provided compact resistors having great resistance to vibration and shock, having high power ratings, having high dielectric strength, and having uniform current flow in the direction perpendicular to the leads.

In the embodiment of FIGS. 1–5, the width of the substrate 32 is made only slightly less than the spacing between sidewalls 21,22, and the length of the substrate is made less than the depth of chamber 16.

Thus, in such first embodiment, it is merely necessary to drop in the film-type resistor element 11, insert the wad 34 (FIG. 4), fill the housing with the potting material 14 and then cure the potting material.

In the embodiment of FIGS. 9–11, the construction is the same except that the substrate **32*a* is made wider than that of the first embodiment by distances approximately equal to the depths of grooves 36,37**. These grooves are relatively shallow.

To assemble the resistor of the second embodiment, the film type resistor element **11*a* is dropped into the rectangular chamber 16 in such manner that the outer regions of the edges of substrate 32*a* substantially fill the grooves 36,37**. Then, potting and curing are effected.

The resilient wad of the first embodiment 34 is a suitable elastomeric substance that is not electrically conductive. A suitable compression spring may also be employed, for example a synthetic resin (non-electrically-conductive) helix.

The foregoing detailed description is to be clearly understood as given by way of illustration and example only, the spirit and scope of this invention being limited solely by the appended claims.

What is claimed is:

1. A high-power, shock-and-vibration-resistant resistor combination, which comprises:

(a) a metal housing having a chamber therein,
 said chamber having a heat-transfer wall,
  the interior and exterior surface of said heat-transfer wall being flat,
 said housing having opening means therein communicating with said chamber and through which leads may be extended, (b) a resistor element sized to fit in said chamber,
 said resistor element comprising a substrate,
  said substrate being electrically insulating but thermally conductive,
  said substrate having upper and lower flat surfaces,
 said resistor element further comprising a resistive film provided on said upper surface of said substrate,
 said resistor element being disposed in said chamber with said lower flat surface of said substrate in proximity to said interior flat surface of said heat-transfer wall of said housing, (c) leads connected to spaced-apart portions of said resistive film,
 said leads extending through said opening means, and (d) means including potting material filling said chamber at the portions thereof not occupied by said resistor element and said leads, said means including potting material consisting of two portions, one such portion having been introduced into said chamber in solid condition and sized to extend between said upper surface of said substrate and a portion of said housing that is opposite said upper surface, the other such portion having been introduced into said chamber in liquid form and then cured.

2. The invention as claimed in claim 1, in which a metal extension wall is integrally connected to said housing, said extension wall having a flat bottom surface co-planar with said flat exterior surface of said heat-transfer wall, said extension wall having a bolthole therethrough.

3. The invention as claimed in claim 1, in which said metal housing is a die casting.

4. The invention as claimed in claim 3, in which said die casting is a zinc alloy.

5. The invention as claimed in claim 1, in which groove means are provided interiorly in said housing adjacent said interior surface of said heat-transfer wall and in communication with said chamber, and in which said substrate has edge portions disposed in said groove means to hold said lower substrate surface adjacent said interior surface of said heat-transfer wall.

6. The invention as claimed in claim 1, in which said resistive film is a thick-film resistive film applied by screen-printing onto said upper surface of said substrate.

7. The invention as claimed in claim 6, in which two conductive termination traces are provided on said upper surface of said substrate in substantially parallel relationship to each other, in which said termination traces are spaced from each other, in which said resistive film extends between said termination traces, and in which said leads are respectively connected to said termination traces.

8. The invention as claimed in claim 7, in which a trimming slot is provided through said resistive film in substantially perpendicular relationship to said termination traces, and in which the direction of current flow through said resistive film between said termination traces is parallel to said trimming slot.

9. The invention as claimed in claim 8, in which a protective coating is provided over said resistive film and over said termination traces, to prevent said means including potting material from contacting the same.

* * * * *